United States Patent [19]

Day

[11] Patent Number: 4,459,011

[45] Date of Patent: Jul. 10, 1984

[54] COMPACT SCREEN PROJECTOR

[75] Inventor: Pierce B. Day, Pittsford, N.Y.

[73] Assignee: Eastman Kodak Company, Rochester, N.Y.

[21] Appl. No.: 466,402

[22] Filed: Feb. 15, 1983

[51] Int. Cl.[3] ..... G03G 15/00; G03G 15/30

[52] U.S. Cl. ..... 355/11; 355/3 R; 355/67; 355/71

[58] Field of Search ..... 355/11, 3 R, 67, 71, 355/8, 66

[56] References Cited

U.S. PATENT DOCUMENTS

| | | | |
|---|---|---|---|
| 2,598,732 | 6/1952 | Walkup | 430/120 X |
| 3,121,010 | 2/1964 | Johnson et al. | 355/3 R X |
| 3,493,381 | 2/1970 | Maurer | 355/3 R X |
| 3,535,036 | 10/1970 | Starkweather | 355/11 |
| 3,540,806 | 11/1970 | Starkweather | 355/3 R |
| 3,776,633 | 12/1973 | Frosch et al. | 355/132 |
| 3,809,555 | 5/1974 | Marley | 355/132 |
| 3,914,047 | 10/1975 | Hunt, Jr. et al. | 355/3 R X |
| 3,936,173 | 2/1976 | Kidd et al. | 355/16 |
| 3,958,732 | 5/1976 | Aoyama et al. | 225/2 |
| 3,958,877 | 5/1976 | Menon et al. | 355/4 |
| 4,012,776 | 3/1977 | Mrdjen | 358/75 |
| 4,227,795 | 10/1980 | Bobbe et al. | 355/3 R |
| 4,407,581 | 10/1983 | Shogren et al. | 355/11 X |
| 4,421,403 | 12/1983 | Sato et al. | 355/11 X |

*Primary Examiner*—A. C. Prescott

*Attorney, Agent, or Firm*—G. Herman Childress

[57] ABSTRACT

A duplicator has a photoconductor on which electrostatic images are formed. A member having a screen pattern of opaque and transparent areas is positioned adjacent to the photoconductor. A Fresnel lens near the screen member receives light rays from a concentrated light source spaced from the lens. Means are provided for folding light rays from the source a plurality of times and then directing the light rays onto the lens, thereby to provide collimated light rays that are directed onto the member to provide an image of the screen pattern onto the photoconductor. The light rays can be folded by means of a polygon of glass or other suitable materials, or by two parallel mirrors and a plurality of baffles arranged so that the light rays are reflected repeatedly from one mirror surface to the other. By folding the light rays a plurality of times, the distance traveled by light rays from the light source to the Fresnel lens can be equal to the focal length of the Fresnel lens and, at the same time, the projection apparatus can be quite small or compact.

5 Claims, 3 Drawing Figures

COMPACT SCREEN PROJECTOR

BACKGROUND OF THE INVENTION

The present invention relates to apparatus for projecting a screen pattern onto a light-sensitive surface and, more particularly, to compact apparatus for projecting a line screen pattern onto a photoconductor of a duplicator or the like from a point light source.

The use of screen patterns and screening processes to improve the rendition of images is well known in the fields of photography and electrography. See, for example, U.S. Pat. No. 3,493,381, which issued in the name of R. E. Maurer on Feb. 3, 1970, and U.S. Pat. No. 2,598,732, which issued in the name of L. E. Walkup on June 3, 1952. These patents also disclose a variety of screen patterns including lines, circular or rectangular dots, checkerboard patterns, etc.

The optical system disclosed in U.S. Pat. No. 3,936,173 which issued on Feb. 3, 1976 in the names of W. L. Kidd et al, is used for projecting a screened light pattern onto a photoconductor that also receives a light image of an original document. The screening apparatus includes an electroluminescent panel that is energized from a suitable power supply and the resulting light rays are projected from that panel through a collimator or lens strip. The resulting collimated light rays are then transmitted through a screen having a pattern of lines or dots thereon to form a screened light image which is projected onto a photoconductor.

In some of the prior art devices the light source can be located at a convenient distance as required by the optical system. In other instances, such as in the U.S. Pat. No. 3,936,173, special light collimators are provided for handling light from elongate luminescent sources in order to provide the desired collimated light beam to a dot or line screen. However, in some electrophotographic apparatus there is very little space or area available within the apparatus to place a screen projector. In addition, it frequently is desireable to provide a small, concentrated point light source as the projection lamp instead of elongate lamps. In accordance with the present invention the desireable collimated light rays are provided to a screen pattern over a narrow, rectangular aperature within a restricted space envelope, and such is accomplished while using a small, concentrated point light source.

SUMMARY OF THE INVENTION

In accordance with the present invention apparatus is provided for projecting a screen pattern onto a light sensitive surface, such as a photoconductor of a copier/duplicator or the like. The projecting apparatus comprises a member having a screen pattern including opaque and transparent areas. The member is positioned adjacent the photoconductive surface, and a Fresnel lens is located adjacent the member and on the opposite side thereof from the photoconductive surface. A concentrated source of light rays is spaced from the Fresnel lens, and means are provided for folding light rays from the light source a plurality of times and then directing the light rays onto the lens. This provides collimated light rays from the lens onto the member containing the screen pattern. The path of the light rays from the source to the lens is substantially equal to the focal length of the lens and is substantially greater than the direct distance from the light source to the lens.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
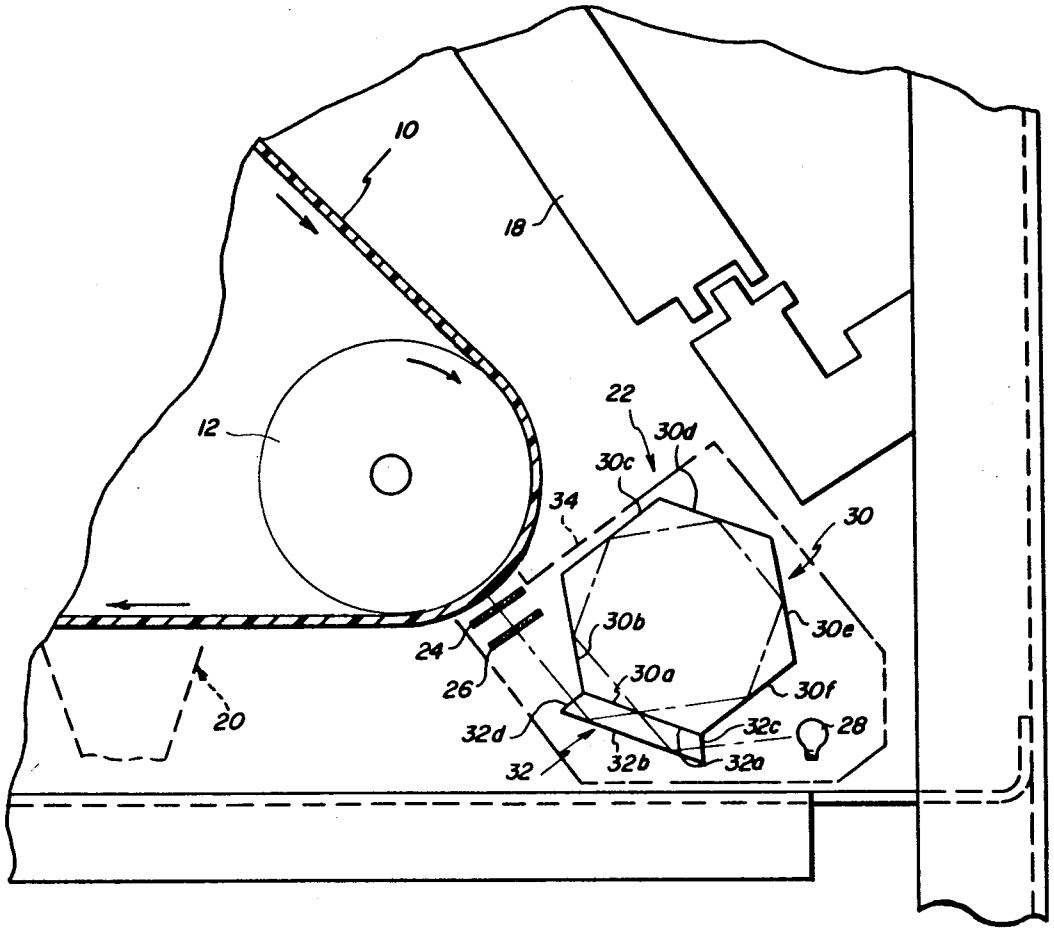
FIG. 1 is a fragmentary view of a portion of a copier/duplicator and illustrating one preferred embodiment of a compact screen projector of the present invention.

The invention is particularly adapted for use with a copier/duplicator as generally disclosed in commonly assigned U.S. Pat. No. 3,914,047 which issued on Oct. 21, 1975 in the name of W. E. Hunt, Jr. et al and is entitled SYNCHRONIZING CONTROL APPARATUS FOR ELECTROPHOTOGRAPHIC APPARATUS UTILIZING DIGITAL COMPUTER. Such a copier/duplicator comprises a photoconductor 10 in the form of a flexible, endless belt that travels around a plurality of rollers, including a roller designated 12 in FIG. 1. One of the rollers is a driven roller for advancing the photoconductor in the direction indicated by the arrows in FIG. 1. The photoconductor has a plurality of holes or slots 16. The photoconductor 10 is driven along an endless path leading past a plurality of work stations of a copier/duplicator or the like as disclosed in more detail in the before-mentioned U.S. Pat. No. 3,914,047. For example, the belt is advanced past a primary charger 18 which is effective to provide an electric charge onto the adjacent surface of the photoconductor just before the photoconductor travels around the drive roller 12. The charged surface of the photoconductor is driven past an exposure station 20 where an image of the original to be reproduced is formed onto the photoconductor by selectively discharging some of the electrostatic charge on the belt to produce a latent image. That image is then developed and transferred to a receiver member or sheet in a known manner.

In accordance with the present invention projector apparatus generally designated 22 is provided for projecting onto the moving photoconductor 10 an image of a screen pattern that selectively discharges portions of the electrostatic charge on the photoconductor to improve the rendition of toned images produced by the copier/duplicator apparatus. The projector apparatus 22 comprises a screen member 24 that is positioned closely adjacent to the photoconductor 10. As illustrated in the drawings, the screen member 24 is closely adjacent the portion of the photoconductor passing around the drive roller 12. Thus the screen member is located between the primary charger 18 and the exposure station 20 of the electrophotographic apparatus. Screen member 24 has thereon a screen pattern comprising opaque and transparent areas. For example, the screen pattern may comprise a line pattern of a type known in the art.

A Fresnel lens 26 is located adjacent member 24 and is positioned on the side of member 24 opposite from the photoconductor 10. The Fresnel lens preferably comprises a narrow section taken out of the center portion of a Fresnel lens. By way of example, the Fresnel lens can be approximately 2.5 cm. wide and taken out of the center of a Fresnel lens of about 35 cm. in diameter and having a focal length of about 28 cm. The Fresnel lens provides a collimated light beam to the screen member 24 so that a sharp image the full width of the screen can be provided onto the photoconductor.

Light rays for the projector apparatus originate at a small, concentrated light source 28 such as, for example, a tungesten halogen projection lamp.

An important feature of the present invention is the provision of means for folding light rays from the light source 28 and compacting the light path between the source and the Fresnel lens 26. The folding means illustrated in FIGS. 1 and 2 comprises a polygon 30 made of solid glass, Lucite or other suitable material. The illustrated polygon 30 comprises a hexagon having six sides 30*a*, 30*b*, 30*c*, 30*d*, 30*e* and 30*f*. Each of the sides of the polygon are the same size. A plate 32 of trapezoidal cross section comprises upper and lower parallel faces 32*a* and 32*b*, respectively and end faces 32*c* and 32*d*. Face 32*a* of the plate is cemented to side 30*a* of the polygon. Plate side 32*a* is the same length and width as the side 30*a* of the polygon.

The polygon 30, plate 32 and lamp 28 are located relative to each other so that surface 32 of the plate is substantially perpendicular to light rays emanating from the source 28. Thus light rays will enter the plate through surface 32*c* and be reflected from the surface 32*b* of the plate into the polygon 30 through surface 30*a*. The light rays then are reflected off of the surfaces 30*b*, 30*c*, 30*d*, 30*e* and 30*f* of the polygon. The light rays then leave the polygon through the surface 32*a* of the plate, are reflected off of the surface 32*b* and leave the plate through the surface 32*d*. The light rays then pass through the Fresnel lens 26, which collimates the beam of light and provides a collimated light source to screen 24. Some of the light rays striking screen 24 pass through the transparent portions thereof and strike the charged photoconductive belt 10 to selectively discharge portions of the belt.

Faces 30*b*–30*f* of the polygon can be pointed or otherwise covered with a material that will prevent light rays from escaping from the polygon except through face 30*a*. This will improve the efficiency of the projector.

The use of a polygon in the projector apparatus is desireable because the substantially total internal reflection of light at each surface 30*a*–30*f* of the polygon essentially elliminates light losses from the apparatus and therefore provides a highly effecient use of energy from the lamp 28. Moreover, the total distance travelled by the light rays from lamp 28 to the Fresnel lens 26 should be equal to approximately the focal length of the Fresnel lens. Thus by reflecting the light from each of the plurality of internal surfaces of the polygon the light rays travel a relatively long distance from the lamp to the Fresnel lens as compared to the direction distance from the lens directly to the lamp. Therefore, the projection apparatus of the invention is highly compact and can be contained within a very restricted space, such as indicated by the dotted lines designated 34 in FIG. 1. This is an advantage in copier/duplicators where very little space is available for the projection apparatus 22. Also, space 34 can be surrounded by a housing to confine any stray light rays and prevent them from striking the photoconductor.

Figure 3:
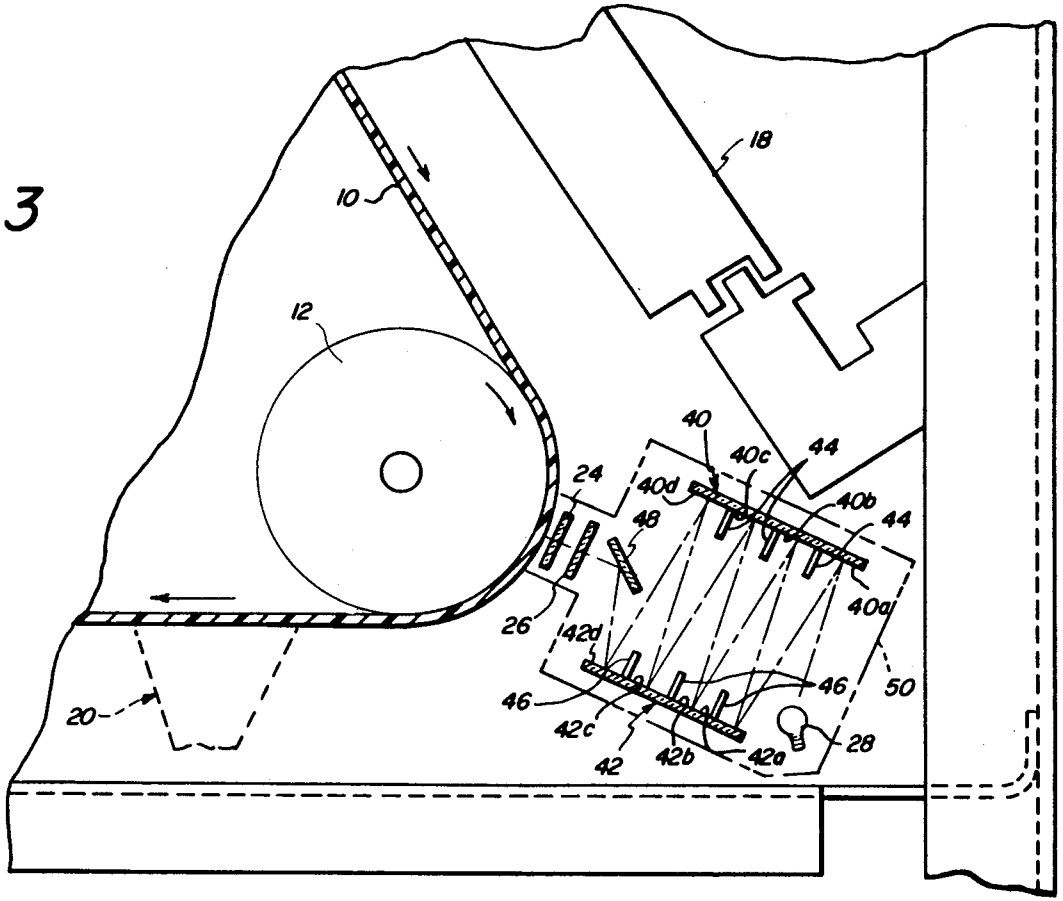
FIG. 3 is a view, similar to FIG. 1, illustrating another embodiment of the projector of the invention.

Another embodiment of the invention is illustrated in FIG. 3 of the drawings where the same references numerals have been used to designate the same or similar structural elements. In FIG. 3 the projection apparatus of the invention utilizes a somewhat different light folding means for providing a compact, a folded light path between the lamp 28 and the Fresnel lens 26. The light folding means illustrated in FIG. 3 comprises a pair of elongate, generally rectangular mirrors 40 and 42 that are positioned in substantially parallel planes and in spaced relation to each other. A plurality of light baffles 44 are provided on the surface of mirror 40 facing mirror 42. Baffles 44 extend the full length of the mirror 40 and are effective to separate the mirror into a plurality of reflecting segments 40*a*–40*d* located adjacent to each other from one side edge of the mirror to the other side edges of the mirror. Similar baffles 46 are provided on the surface of mirror 42 that faces mirror 40 to provide reflecting segments 42*a*–42*d*.

Mirrors 40, 42 are located relative to each other and relative to the lamp 28 and so that light rays emanating from lamp 28 are directed first onto the segment 40*a* of mirror 40 located to the right of the baffle 44 adjacent the right edge of the mirror 40. The resulting light rays are then reflected by mirror segment 40*a* onto the segment 42*a* of mirror 42, i.e., the portion located to the right of the baffle 46 nearest the right edge of mirror 42. The light rays continue to be reflected back and forth between segments of mirrors 40 and 42, as illustrated in FIG. 3, to thereby provide a relatively long light path between lamp 28 and the Fresnel lens 26. The length of the light path is substantially equal to the focal length of lens 26 and is much greater than the direct distance between the lens and the lamp. When the light rays are reflected from the last segment 42 of mirror 42 they strike a separate mirror segment 48 that reflects the light rays to the Fresnel lens 26. As explained before, lens 26 is effective to provide a collimated array of light to the line screen 24 to thereby project a pattern of light onto the photoconductor that corresponds to the pattern of transparent areas on the screen 24. By folding the light path, the FIG. 3 projection apparatus can be contained within the space designated 50 in the drawings. Space 50 can be surrounded by a housing to prevent stray light rays from striking the photoconductor.

Figure 2:
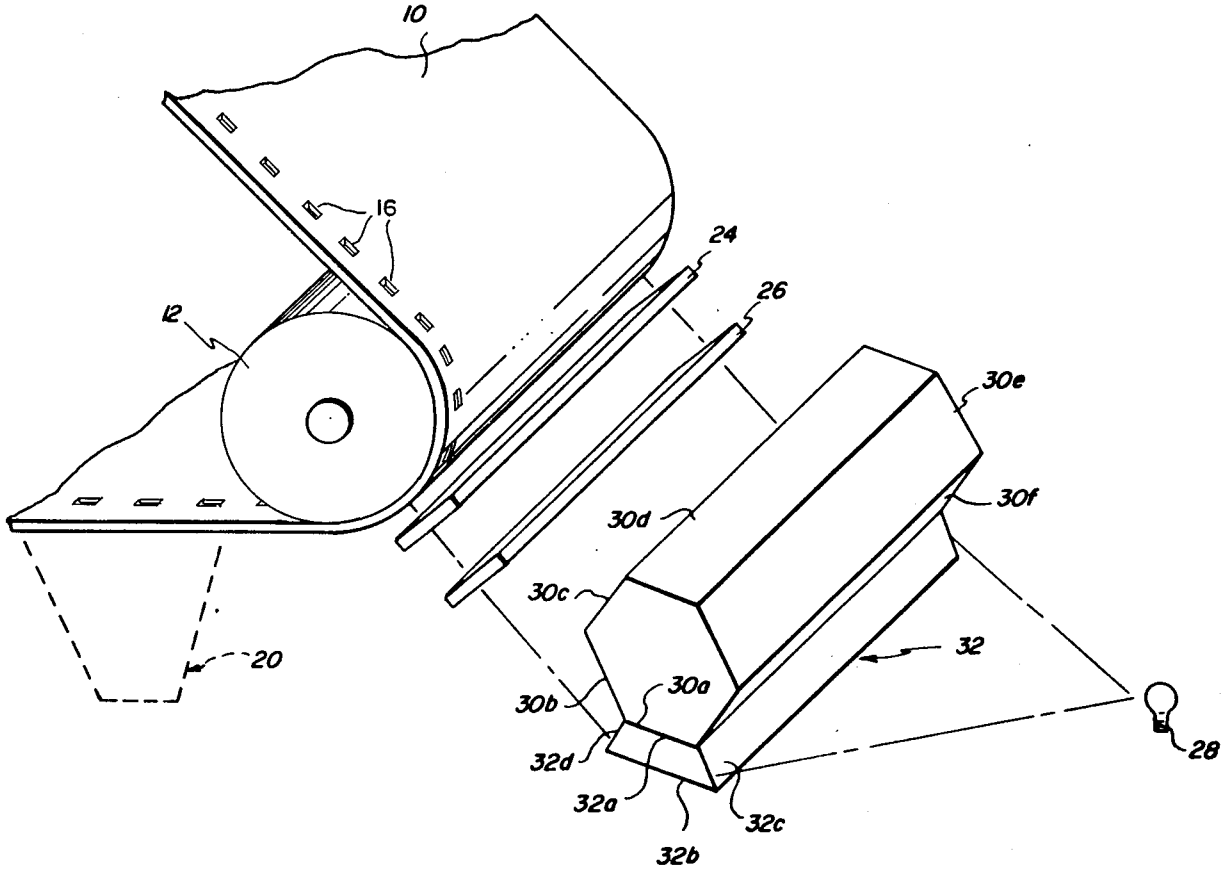
FIG. 2 is a fragmentary exploded perspective view of portions of the apparatus illustrated in FIG. 2.

The use of a polygon as shown at 30 in FIGS. 1 and 2 is desireable because of the total internal reflection at each surface of the polygon reduces light losses and thus reduces the energy that needs to be supplied from the source 28. The use of a polygon also eliminates the need for baffles as shown at 44 and 46 and further reduce the possibility of creation of background streaks due to dirt particles or coating voids on the mirrors. On the other hand, the use of a pair of parallel mirrors and baffles as disclosed in FIG. 3 provides a relatively simple optical construction in order to achieve the desired compact projector and still use only a small concentrated light source. High quality mirror coatings will minimize the cumulative effect of light losses that occur as light is reflected from the surfaces of mirrors 40 and 42.

For projecting screen images of lines, lamp 28 can remain "on" at all times, or be periodically energized in response to a signal from the logic and control unit of the copier/duplicator. For example, the lamp can be energized only when half-tone images are to be copied. When projecting screen images of dots and other patterns, lamp 28 can be periodically energized to repeat the pattern at regular intervals on the photoconductor.

The invention has been described in detail with particular reference to preferred embodiments thereof, but it will be understood that variations and modifications can be effected within the spirit and scope of the invention.

I claim:

1. Apparatus for projecting a screen pattern onto a light-sensitive surface, the apparatus comprising:

a member having a screen pattern comprising opaque and transparent areas, the member being positionable adjacent the surface;

a Fresnel lens located adjacent the member and on the opposite side thereof from the surface;

a concentrated source of light rays spaced from the lens; and means for folding light rays from the source a plurality of times and then directing the light rays onto the lens, thereby to provide collimated light rays from the lens onto the member, the path of the light rays from the source to the lens being substantially equal to the focal length of the lens and being substantially greater than the direct distance from the light source to the lens.

2. The invention as set forth in claim 1 wherein the folding means comprises a transparent solid polygon having a plurality of surfaces for internally reflecting light with a minimum of light loss, and means for directing light rays into the polygon.

3. The invention as set forth in claim 2 wherein the directing means comprises a plate of trapezoidal cross section secured to one surface of the polygon, the polygon and plate being located relative to the light source so that rays of light enter the plate and are reflected from the plate into the polygon through said one surface of the polygon.

4. The invention as set forth in claim 1 wherein the folding means comprises a plurality of mirror surfaces located relative to the light source and the lens to fold the light rays repeatedly between the source and the lens.

5. The invention as set forth in claim 4 wherein the mirror surfaces comprise a pair of parallel mirrors, and a plurality of light baffles positioned on a mirror surfaces to divide the mirrors into a plurality of reflecting segments and to reduce scattering of light rays as the rays are reflected from one mirror to another mirror.

* * * * *